US005847343A

United States Patent [19]

Kim

[11] Patent Number: 5,847,343

[45] Date of Patent: Dec. 8, 1998

[54] REFRIGERATOR DOOR PUSH BUTTON SWITCH SYSTEM

[75] Inventor: Young-Chang Kim, Seoul, Rep. of Korea

[73] Assignee: Daewoo Electronics Co., Ltd., Rep. of Korea

[21] Appl. No.: 865,981

[22] Filed: May 30, 1997

[30] Foreign Application Priority Data

Aug. 31, 1996 [KR] Rep. of Korea ..... 1996 27748

[51] Int. Cl.[6] ..... H01H 3/16

[52] U.S. Cl. ..... 200/61.76; 200/61.58 R; 200/61.69

[58] Field of Search ..... 200/61.58 R, 61.62, 200/61.69, 61.72, 61.75, 61.76, 293, 303; 362/94

[56] References Cited

U.S. PATENT DOCUMENTS

| | | | |
|---|---|---|---|
| 2,795,691 | 11/1957 | Solley, Jr. et al. | 240/4 |
| 3,881,077 | 4/1975 | Piber | 200/61.69 |
| 3,895,198 | 7/1975 | Piber | 200/61.62 |
| 4,300,025 | 11/1981 | Prada | 200/61.69 |

*Primary Examiner*—Wynn Wood Coggins
*Assistant Examiner*—Michael J. Hayes
*Attorney, Agent, or Firm*—Cushman Darby & Cushman Intellectual Property Group of Pillsbury Madison & Sutro, LLP

[57] ABSTRACT

A refrigerator door switch system for sensing opening of a freezer compartment door and a fresh food compartment door comprises a push button switch installed at the freezer compartment door or the fresh food compartment door, being positioned at a first position for stopping a fan motor for a cool air supply and turning on a cabinet lamp when the freezer compartment door or the fresh food compartment door is opened, and being positioned at a second position for driving the fan motor and turning off the cabinet lamp when the freezer compartment door and the fresh food compartment door are closed; and a switch operation cam installed at the fresh food compartment door or the freezer compartment door, corresponding to the push button switch for positioning the push button switch to the first position when the freezer compartment door or the fresh food compartment door is opened, and for positioning the push button switch to the second position when the freezer compartment door and the fresh food compartment door are closed.

3 Claims, 5 Drawing Sheets

REFRIGERATOR DOOR PUSH BUTTON SWITCH SYSTEM

BACKGROUND OF THE INVENTION

1. Field of the Invention

The present invention relates to a refrigerator door switch system, and more particularly to a refrigerator door switch system for sensing opening of at least one of a freezer compartment door and a fresh food compartment door to stop a fan motor, and simultaneously turning on a cabinet lamp.

2. Description of the Prior Art

In general, when a freezer compartment door or a fresh food compartment door of a refrigerator is opened, a cabinet lamp is turned on and a fan motor is stopped, whereas when the freezer compartment door or the fresh food compartment door is closed, the cabinet lamp is turned off and the fan motor is driven. The above opening or closing of the freezer compartment door or the fresh food compartment door is detected by a door switch.

As shown in FIG. 5, a conventional door switch 110 of a plunger shape is disposed at a front side portion 100*a* of a cabinet 100, which is contacted with inner surfaces of a door 101 of a freezer compartment 100*c* and a door 102 of a fresh food compartment 100*b* in a refrigerator.

The door switch 110 is pressed down by the inner surface of the freezer compartment door 101 or the fresh food compartment door 102 when the freezer compartment door 101 or the fresh food compartment door 102 is closed, so that the electric power is supplied to a driving motor (not shown) to drive a fan 103, and simultaneously a cabinet lamp 104*a* or 104*b* is turned off.

However, the above conventional door switch system 110 includes a freezer compartment door switch 111 for sensing opening of the freezer compartment door 101 and a fresh food compartment door switch 112 for sensing opening of the fresh food compartment door 102, each operating individually.

Consequently, the conventional door switch system has a complicated structure due to the need of having the two switches 111 and 112 for sensing opening of the freezer compartment door 101 and the fresh food compartment 102, respectively.

Furthermore, the conventional door switch system is difficult to repair, since all of the switch components are disposed inside the cabinet 100 of the refrigerator.

SUMMARY OF THE INVENTION

In view of the foregoing, it is an object of the present invention to provide a refrigerator door switch system having a simple structure.

It is another object of the present invention to provide a refrigerator door switch system having a simple switching action.

It is still another object of the present invention to provide a refrigerator door switch system, which can be simply repaired.

In order to achieve the above objects, the present invention provides a refrigerator door switch system for sensing opening of a freezer compartment door or a fresh food compartment door comprising:

a push button switch installed at the freezer compartment door or the fresh food compartment door, being positioned at a first position for stopping a fan motor for a cool air supply and turning on a cabinet lamp when the freezer compartment door or the fresh food compartment door is opened, and being positioned at a second position for driving the fan motor and turning off the cabinet lamp when the freezer compartment door and the fresh food compartment door are closed; and a switch operation cam installed at the fresh food compartment door or the freezer compartment door, corresponding to the push button switch for positioning the push button switch to the first position when the freezer compartment door or the fresh food compartment door is opened, and for positioning the push button switch to the second position when the freezer compartment door and the fresh food compartment door are closed.

Here, the push button switch comprises:

a housing fixedly inserted inside the freezer compartment door or the fresh food compartment door;

a switch button of a plunger shape inserted slidably inside the housing, and having an upper spool and a lower spool separated from the upper spool by a predetermined distance;

a first movable contact member and a second movable contact member disposed on an upper side and a lower side of the lower spool of the switch button, respectively;

a first fixed contact member installed at the housing for driving the fan motor when being contacted with the first movable contact member;

a second fixed contact member installed at the housing for turning on the cabinet lamp when being contacted with the second movable contact member; and an elastic member for pushing said switch button so that the second movable contact member of the switch button makes contact with the fixed contact member when the freezer compartment door or the fresh compartment door is opened.

BRIEF DESCRIPTION OF THE DRAWINGS

The above and other objects, features, and advantages of the present invention will be apparent from the following detailed description of the preferred embodiments of the invention in conjunction with the accompanying drawings, in which.

DESCRIPTION OF THE PREFERRED EMBODIMENT

Reference will now be made in detail to the present invention, examples of which are illustrated in the accompanying drawings. Wherever possible, the same reference numbers will be used throughout the drawings to refer to the same or like parts.

Figure 1:
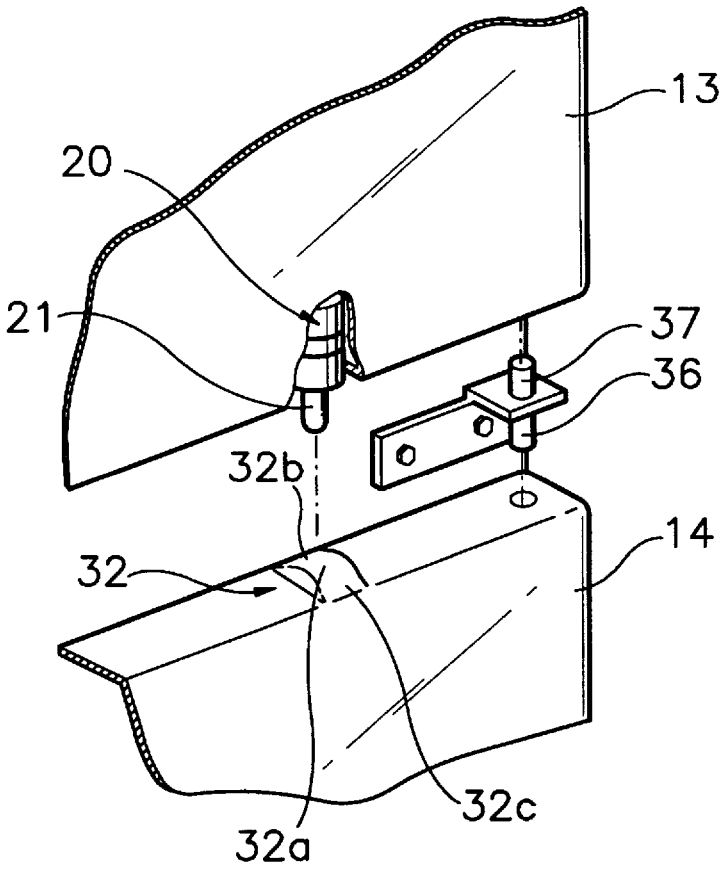
FIG. 1 is a partial sectional view illustrating a push button switch and a switch operation cam of a refrigerator door switch system according to a preferred embodiment of the present invention.

FIG. 1 shows a partially sectional view of a push button switch 20 and a switch operation cam 32 of a refrigerator door switch system according to the present invention. A freezer compartment door 13 and a fresh food compartment door 14 are mounted on the cabinet 100, as shown in FIG. 5, by a hinge structure having the bracket 36 and the hinge shaft 37.

Figure 5:
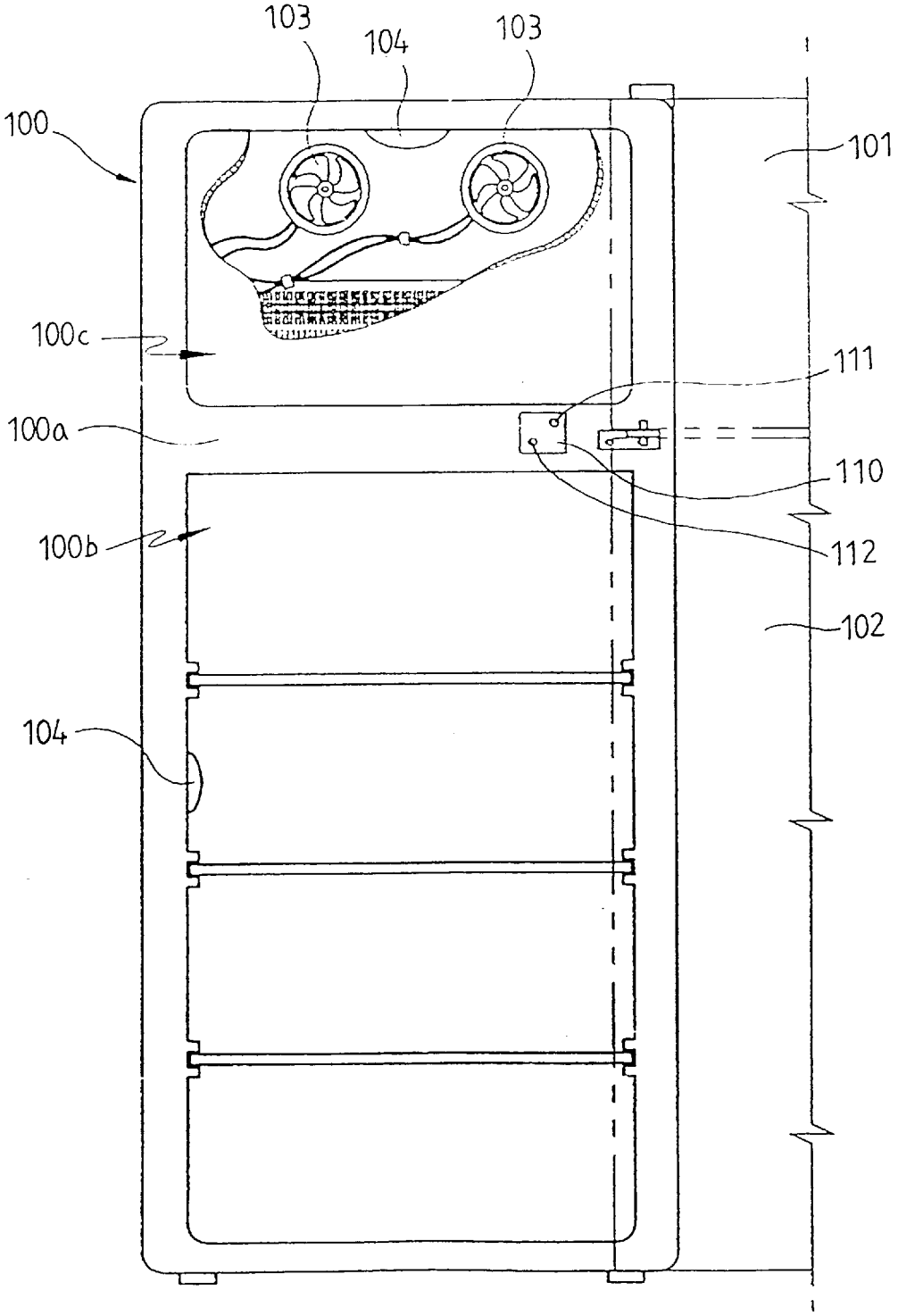
FIG.5 (PRIOR ART)
FIG. 5 is a front view illustrating a conventional refrigerator of which all doors are opened to show a conventional refrigerator door switch.

A fan (not shown) driven by a fan motor (not shown) is installed in the freezer compartment 101, as shown in FIG. 5. To prevent loss of cool air, the fan motor is stopped when any one of the freezer compartment door 13 and the fresh food compartment door 14 is opened.

Further, cabinet lamps (not shown) are installed in the freezer and fresh food compartments 101 and 102, as shown in FIG. 5, respectively. Each cabinet lamp turns on when the freezer compartment door 13 or the fresh food compartment door 14 is opened.

Figure 2:
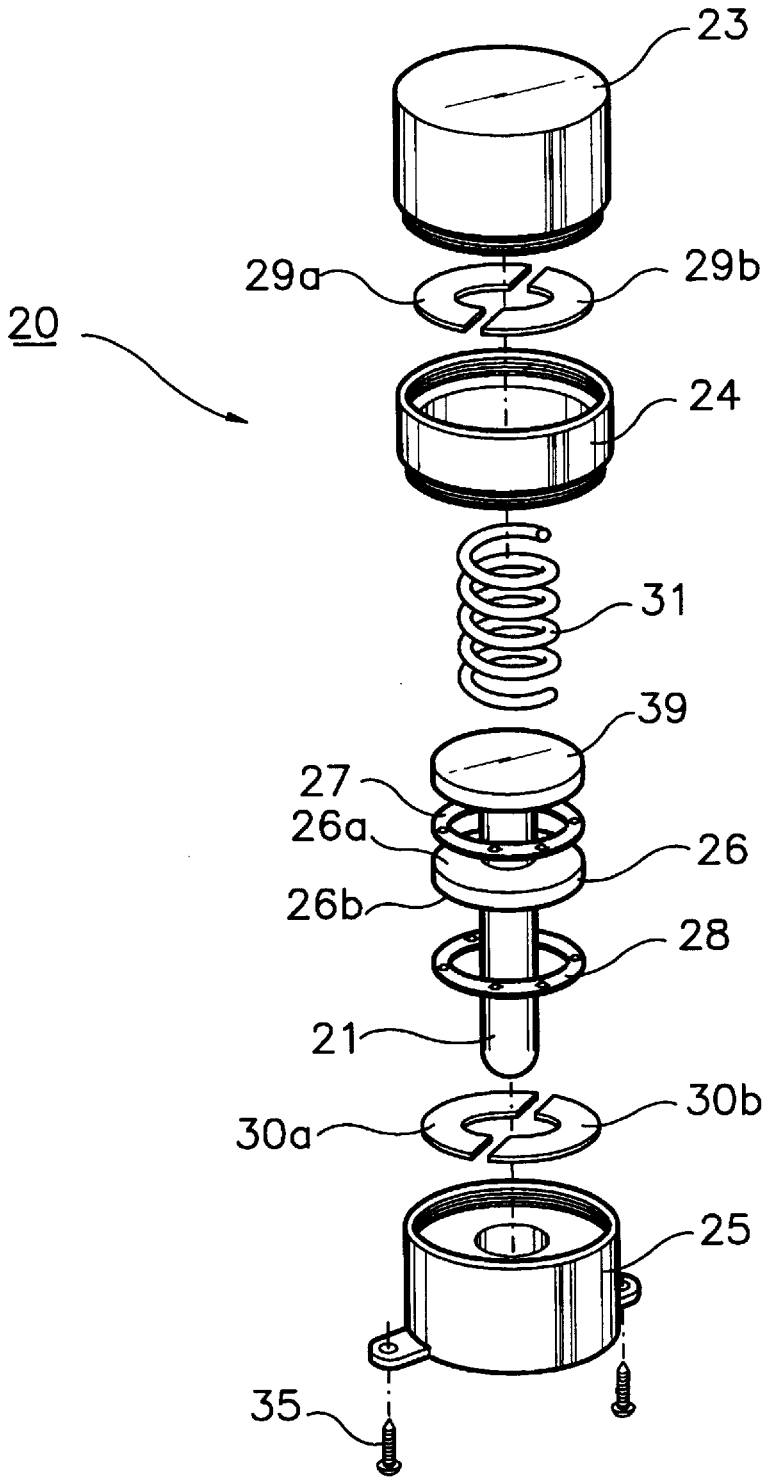
FIG. 2 is an exploded perspective view illustrating a push button switch in the refrigerator door switch system in FIG. 1.

Referring to FIGS. 1 and 2, a push button switch 20 is inserted into a lower end portion of the freezer compartment door 13 and fixed by a fastening screw 35. A lower end of a switch button 21 of the push button switch 20 is projected downward from the lower end portion of the freezer compartment door 13.

A switch operation cam 32 is formed on an upper end portion of the fresh food compartment door 14 faces the switch button 21 of the push button switch 20. The switch button 21 is pressed when being contacted with the switch operation cam 32 of the fresh food compartment door 14.

Figure 3:
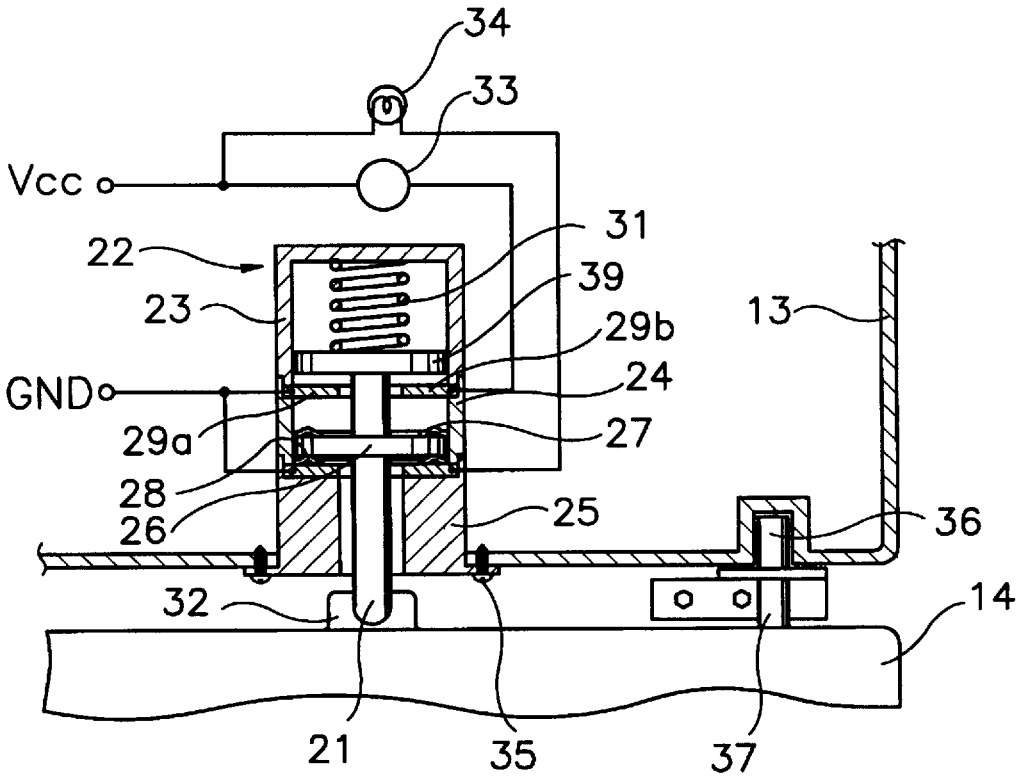
FIG. 3 is a schematic view illustrating an operation state of the refrigerator door switch system of FIG. 1 with its electric circuit when any one door of the refrigerator is opened.

Referring to FIGS. 2 and 3, the push button switch 20 comprises a housing 22 having an upper housing 23, a central housing 24, and a lower housing 25, which are fastened by a screw structure.

The switch button 21 is of a plunger type and inserted slidably inside the housing 22. The switch button 21 is formed with an upper spool 39 and a lower spool 26 having an upper side 26*a* and a lower side 26*b* to which a first movable contact member 27 and a second movable contact member 28 are attached, respectively.

A couple of first fixed contact members 29*a* and 29*b* are disposed between the upper spool 39 and the first movable contact member 27. When the first fixed contact members 29*a* and 29*b* are contacted to the first movable contact member 27, an electric circuit of the fan motor is electrically connected, thereby driving the fan motor.

Further, a couple of second fixed contact members 30*a* and 30*b* are disposed between the second movable contact member 28 and the lower housing 25. When the second fixed contact members 30*a* and 30*b* are contacted to the second movable contact member 28, an electric circuit of the cabinet lamp is electrically connected, thereby turning on the cabinet lamp.

An elastic member such as a compression coil spring 31 is disposed between the upper housing 23 and the upper spool 39 of the switch button 21 to push the switch button 21 downward.

Figure 4:
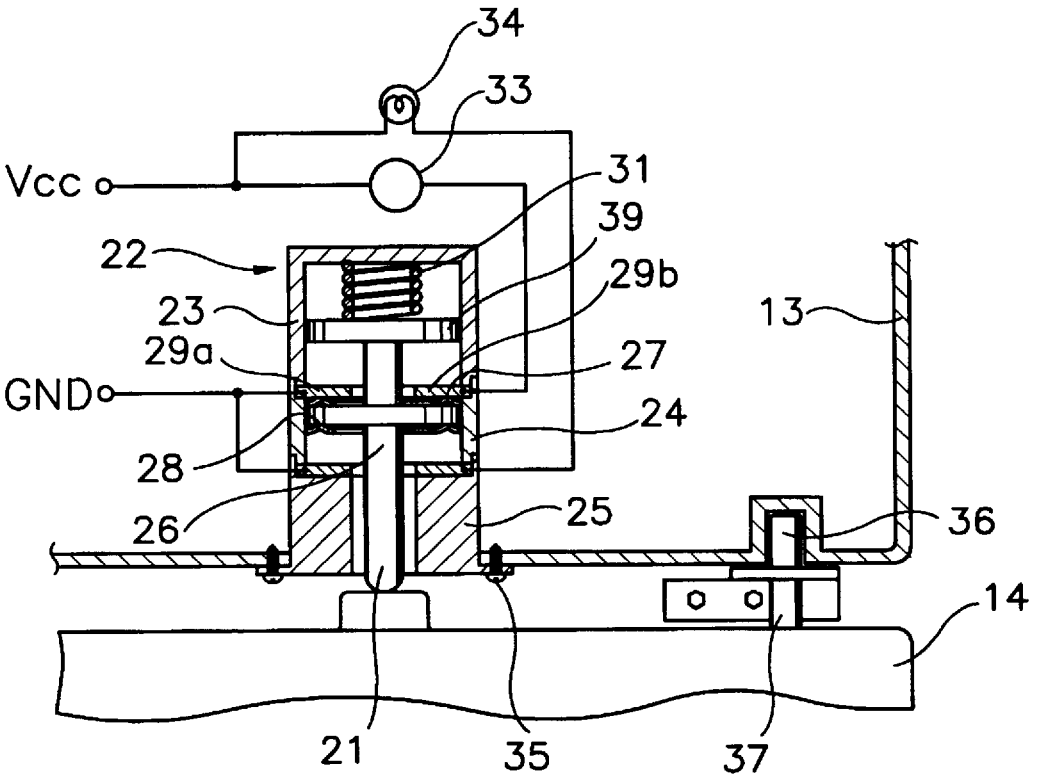
FIG. 4 is a schematic view illustrating an other operation state of the refrigerator door switch system of FIG. 1 with its electric circuit when all doors of the refrigerator are closed.

Referring to FIGS. 1 and 2, the switch operation cam 32 comprises a top portion 32*a*, a first incline 32*b*, and a second incline 32*e*. By the top portion 32*g*, the switch button 21 is pressed to its upper most position when the two doors 13 and 14 are closed. At this time, the first movable contact member 27 is contacted with the first fixed contact members 29*a* and 29*b*. Accordingly, the fan motor 33 is electrically connected, thereby driving the fan motor and simultaneously turning off the cabinet lamp 34, as shown in FIG. 4.

When the freezer compartment door 13 is opened, the switch button 21 is released while sliding down along the second incline 32*c* of the switch operation cam 32 by an elastic force of the spring 31. At this time, the first movable contact member 27 is separated from the first fixed contact members 29*a* and 29*b*, and the second movable contact member 28 makes contact with the second fixed contact members 30*a* and 30*b*. Thus, the fan motor 33 is stopped, and simultaneously, the cabinet lamp 34 is turned on.

Accordingly, when the freezer compartment door 13 is opened, the cabinet lamp 34 is turned on automatically to brighten the inside of the freezer compartment 101, as shown in FIG. 5. Simultaneously, the fan motor 33 is not driven, thereby preventing loss of the cool air.

On the contrary, when the fresh food compartment door 14 is opened, the switch operation cam 32 is moved horizontally with the opening of the fresh food compartment door 14 to release the switch button 21. At this time, the switch button 21 slides down on the first incline 32*b* of the switch operation cam 32 by the elastic force of the spring 31.

As in this case of the freezer compartment door 13, the first movable contact member 27 is separated from the first fixed contact members 29*a* and 29*b*, and the second movable contact member 28 makes contact with the second fixed contact members 30*a* and 30*b*, so that the fan motor 33 stops, and simultaneously, the cabinet lamp 34 is turned on.

Namely, when the fresh food compartment door 14 is opened, the cabinet lamp is turned on automatically to brighten the inside of the fresh food compartment 102, as shown in FIG. 5. Simultaneously, the fan motor 33 is not driven, thereby preventing loss of the cool air.

As described above, the push button switch 20 is disposed on the freezer compartment door 13 and the switch operation cam 32 is disposed on the fresh food compartment door 14. However, the present invention may be structured such that the push button switch 20 is disposed on the fresh food compartment door 14 and the switch operation cam 32 is disposed on the freezer compartment door 13.

Therefore, the refrigerator door switch system according to the present invention has a simple structure, since opening of the two doors of the refrigerator is sensed by using one push button switch and one switch operation cam. Furthermore, the door switch system can be easily repaired since the push button switch and the switch operation cam are disposed on the two doors of the refrigerator, respectively.

While this invention has been described in connection with what is presently considered to be the most practical and preferred embodiments, it is to be understood that the invention is not limited to the disclosed embodiment, but, on the contrary, it is intended to cover various modifications and equivalent arrangements included within the spirit and scope of the appended claims.

What is claimed is:

1. A refrigerator door switch system for sensing opening of a freezer compartment door and a fresh food compartment door, comprising:

a push button switch installed at a lower end portion of the freezer compartment door, being positioned at a first position for stopping a fan motor for a cool air, supply and turning on a cabinet lamp when the freezer compartment door or the fresh food compartment door is opened, and being positioned at a second position for driving the fan motor and turning off the cabinet lamp when the freezer compartment door and the fresh food compartment door are closed; and a switch operation cam installed at an upper end portion of the fresh food compartment door, corresponding to said push button switch, for positioning said push button switch to said first position when the freezer compartment door or the fresh food compartment door is opened, and for positioning said push button switch to said second position when the freezer compartment door and the fresh food compartment door are closed.

2. The refrigerator door switch system of claim 1, wherein said push button switch comprises:

a housing fixedly inserted inside the freezer compartment door;

a switch button of a plunger shape inserted slidably inside said housing, and having an upper spool and a lower spool separated from the upper spool by a predetermined distance;

a first movable contact member and a second movable contact member disposed on an upper side and a lower side of the lower spool of said switch button, respectively;

a first fixed contact member installed at said housing for driving the fan motor when being contacted with said first movable contact member;

a second fixed contact member installed at said housing for turning on the cabinet lamp when being contacted with said second movable contact member; and an elastic member for pushing said switch button so that said second movable contact member of said switch button is contacted with said fixed contact member when the freezer compartment door or the fresh compartment door is opened.

3. The refrigerator door switch system of claim 1, wherein said switch operation cam comprises a central top portion, and a first incline and a second incline, which are inclinedly extended from opposite sides of said top portion.

* * * * *